US009616310B2

(12) United States Patent
Manley

(10) Patent No.: US 9,616,310 B2
(45) Date of Patent: Apr. 11, 2017

(54) HARNESS FOR MARTIAL ARTS TRAINING, PROFESSIONAL MIXED MARTIAL ARTS AND BOXING TRAINING, COMBAT TRAINING, FITNESS TRAINING, AND STRIKING TRAINING AND PRACTICE

(71) Applicant: Stryko Limited, Columbus, OH (US)

(72) Inventor: Ronald L. Manley, Lewis Center, OH (US)

(73) Assignee: STRYKO LIMITED, Columbus, OH (US)

( * ) Notice: Subject to any disclaimer, the term of this patent is extended or adjusted under 35 U.S.C. 154(b) by 0 days.

(21) Appl. No.: 14/189,647

(22) Filed: Feb. 25, 2014

(65) Prior Publication Data

US 2015/0057131 A1 Feb. 26, 2015

Related U.S. Application Data

(60) Provisional application No. 61/868,655, filed on Aug. 22, 2013.

(51) Int. Cl.

| | |
|---|---|
| ***A63B 69/34*** | (2006.01) |
| ***A63B 69/00*** | (2006.01) |
| ***A63B 69/26*** | (2006.01) |
| *A63B 71/12* | (2006.01) |

(52) U.S. Cl.

CPC ..... *A63B 69/004* (2013.01); *A63B 69/26* (2013.01); *A63B 71/12* (2013.01); *A63B 2208/12* (2013.01); *A63B 2209/10* (2013.01)

(58) Field of Classification Search

CPC ... A63B 69/004; A63B 71/0054; A63B 71/08; F41H 5/08

See application file for complete search history.

(56) References Cited

U.S. PATENT DOCUMENTS

| | | | | |
|---|---|---|---|---|
| 2,574,046 | A | 11/1951 | Logan | |
| 3,759,515 | A | 9/1973 | Crooks | |
| 3,866,909 | A * | 2/1975 | DeSantis | A42B 3/0433 2/411 |
| 4,546,966 | A | 10/1985 | Segura | |
| 4,667,954 | A * | 5/1987 | McCorkle | A63B 69/26 473/444 |
| 5,501,649 | A | 3/1996 | Queppet | |
| 9,022,904 | B1 * | 5/2015 | Dorsey, III | A63B 69/004 482/83 |
| D745,218 | S * | 12/2015 | Manley | D29/101.4 |
| 2013/0185852 | A1 | 7/2013 | Vince et al. | |

* cited by examiner

*Primary Examiner* — Loan H Thanh
*Assistant Examiner* — Megan Anderson
(74) *Attorney, Agent, or Firm* — Jason H. Foster; Kremblas & Foster

(57) ABSTRACT

A device to be worn or otherwise attached to a first person (wearer) so that a second person (training athlete) can strike the device to simulate movements in an athletic competition, combat training or to allow fitness movements. A central pad is mounted to the wearer using a series of straps or other structures, and preferably two handles are mounted to the lateral sides of the central pad. The wearer holds the handles while the training athlete punches, kicks, knees, elbows, or forearms the central pad. The wearer can move the central pad using the handles, or can brace himself or herself with the handles, or both.

27 Claims, 5 Drawing Sheets

HARNESS FOR MARTIAL ARTS TRAINING, PROFESSIONAL MIXED MARTIAL ARTS AND BOXING TRAINING, COMBAT TRAINING, FITNESS TRAINING, AND STRIKING TRAINING AND PRACTICE

CROSS-REFERENCES TO RELATED APPLICATIONS

This application claims the benefit of U.S. Provisional Application No. 61/868,655 filed Aug. 22, 2013. This prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to martial arts training, professional mixed martial arts and boxing training, combat training and fitness training equipment, and more particularly to a device for one person to wear while another person strikes the equipment to develop and improve skills in martial arts, professional mixed martial arts and boxing, combat training, and fitness training.

In the fields of physical fitness activities, contact between athletes is often encountered. This is desirable when training and practicing contact sports, such as boxing, kickboxing and any of the martial arts. It is known that contact during instruction and training can be imperfect, which can harm the target of the impact. Even if the contact is perfect, repetitive blows can harm the athlete and the recipient of the impact. It is preferred that athletes train for contests in contact sports by engaging in the types of contact, such as punching, elbowing, forearming, kicking and kneeing, that will occur during the contests. However, many athletes cannot find suitable opponents for training, and such opponents can be injured by successful contact.

Many devices have been invented to enable athletes to simulate sporting contact while a trainer observes and coaches the athlete on his or her form. Speed bags, heavy bags, padded gloves and chest pads are all designed to allow an athlete in training to contact the equipment while the trainer observes and comments. Some equipment, such as padded gloves and chest pads, enables the athlete to more closely simulate punching and kicking while protecting the trainer from harm that could come if the athlete does not execute the punch or kick correctly, or even if he or she does. Such equipment allows the trainer to receive the impact, which gives the trainer insight into the power and location of the impact, and also gives the trainer a vantage point and options for training that are not otherwise available to trainers who view the training from a distance.

To the inventor's knowledge, no equipment has been invented that allows an athlete to accurately simulate punching, elbowing, forearming, kicking and kneeing another person while still protecting the other person, particularly while also allowing the other person to move around as an opposing athlete would. In particular, it is desired for the trainer to be able to move across a floor, mat, canvas, or other area with his or her feet to simulate the way an opponent athlete moves while the athlete being trained punches, elbows, forearms, kicks and knees the device worn by the trainer as the athlete would punch, elbow, forearm, kick and knee an opponent during a contest.

BRIEF SUMMARY OF THE INVENTION

The present application discloses a device for attaching to a first person so that a second person can strike the first person, or rather the device worn by the first person, during martial arts, mixed martial arts, boxing, combat, and/or fitness training. A central pad absorbs energy of each blow, thereby protecting the user/wearer as well as the training athlete delivering the blows to the device, from injury.

More particularly, the device's central pad is preferably enclosed in a skin of flexible material that also contains at least one means for attaching the skin to the wearer. A plurality of straps is envisioned, but the means for attachment can alternatively be rope, belts, fabric, or any type of garment or quasi-garment that can attach the central pad to the wearer's central anterior. The central pad is made of material that receives the mechanical blow delivered by the training athlete striking the device, and reacts in such a way that the wearer of the device feels little to no pain, and receives no harm at all.

A pair of opposite handles allow the wearer of the device to grip in a central location that the hands naturally extend to such that maximum strength and control can be imparted to the central pad against the blows. The arms are preferably bent at about ninety degree angles and extend anteriorly to the lateral sides of the central pad near the posterior of the pad. This allows the wearer to move the central pad to give the training athlete a "moving target", and the configuration also allows the wearer to brace the central pad sufficiently that the training athlete delivering the blows does not move the central pad too much with each impact.

A groin guard prevents groin injuries, and hand guards cover the handles on each side to form a pocket into which the hands slide to reach the handles.

Figure 1:
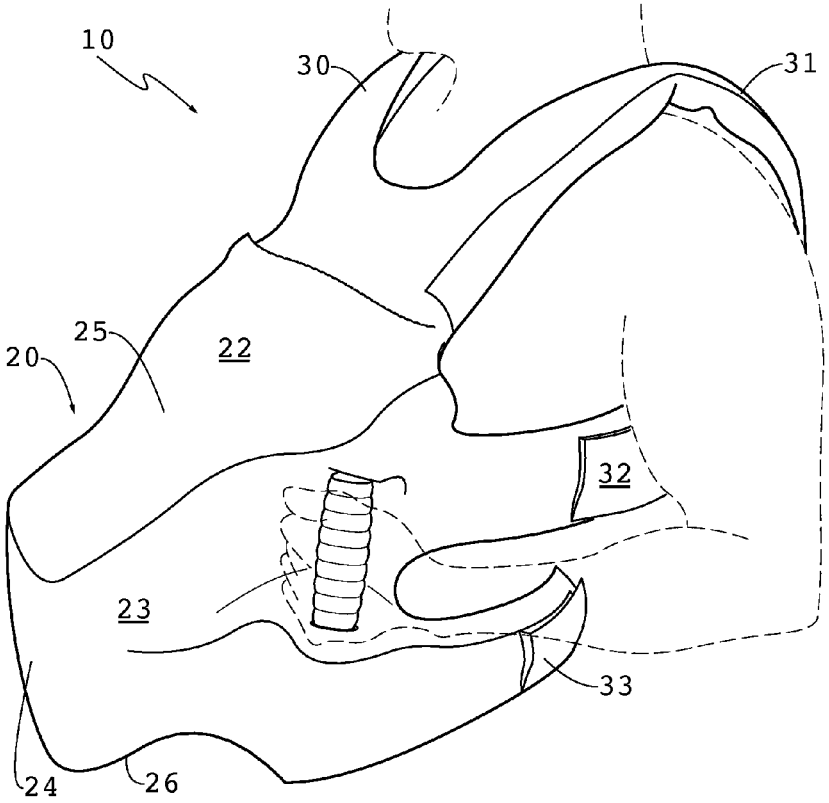
FIG. 1 is a front view in perspective illustrating an embodiment of the present invention in an operable position on a human wearer.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Provisional Patent application Ser. No. 61/868,655, which is the above claimed priority application, is incorporated in this application by reference.

A training device 10 is disclosed that has a central pad 20 attached to means for mounting to a human body. The central pad 20 preferably includes an open cell, synthetic polymer foam padding (not visible) housed in a flexible skin 22. The flexible skin can be leather, artificial leather, polyurethane, fabric or any other thin, flexible material that will not readily tear when punched, elbowed, forearmed, kicked and kneed, but that also has enough flexibility (and elastomeric properties, if desired) to present little resistance to the force applied by a training athlete punching, elbowing, forearming, kicking and kneeing or otherwise contacting the pad 20. The resistance to the force of contact should come from the padding within the skin, because the padding is an energy-absorbing material. The material is "energy-absorbing," which is defined for the purposes of the invention as meaning that it converts mechanical energy into other forms of energy, typically thermal, thereby reducing the amount of energy transferred to the wearer of the device 10. In the preferred embodiment, the energy of impact is converted by the padding deforming mechanically, which is essentially converting mechanical energy into thermal and other forms of energy (assuming conservation of energy) that are not significantly noticed by the wearer. The energy-absorbing material assists with the conditioning of the martial arts, mixed martial arts, boxing, combat, and/or fitness training athletes during training. Of course, other mechanisms for absorbing energy are known, and include mechanical structures (shock-absorbers) and materials that deform in unique manners, such as non-Newtonian fluids.

The foam padding used for the central pad 20 is preferably similar to, but more firm than, the padding found in sofa cushions. A preferred foam padding has a density of about 1.8 (plus or minus 0.1) lbs per cubic foot, with a tensile strength of about 12.0 lbs per inch and elongation of about 120% before fracture. The preferred foam has an Indentation Force Deflection (IFD) in the range of 46-54 lbs/50 square inches (IFD is determined using a standard test in which the amount of force required to compress the foam 25% of its thickness is measured). Foam having an IFD in the range of about 10 to about 80 and a density ranging from about one to about 2.5 lbs per cubic foot will suffice for the purposes of the invention. However, it is more preferred that the foam have an IFD in a range of about 30 to about 65 and a density of about 1.5 to about 2.0 lbs per cubic foot.

Of course, a person having ordinary skill will understand from the description herein that the foam padding used can be varied from this in order to accommodate the training that is suitable for the training athlete.

Preferably the combination of the skin 22 and the padding that make up the central pad 20 will simulate the hardness, resistance to impact and other characteristics of the trunk of an opponent in a contest in which the athlete will compete, or will be different from these characteristics for reasons related to training advantages. The central pad 20 receives the mechanical energy of an impact, including without limitation a punch, kick, upwardly extended knee, downwardly extended elbow, downwardly extended forearm. The pad 20 reduces the amount of, and increases the time period of application of, mechanical energy that is applied to the human wearer of the device 10. Thus, the central pad 20 reduces the felt impact to the wearer of the device 10 of the punch, elbow, forearm, kick, and knee, thereby leaving the wearer unharmed after many blows by the training athlete.

Figure 3:
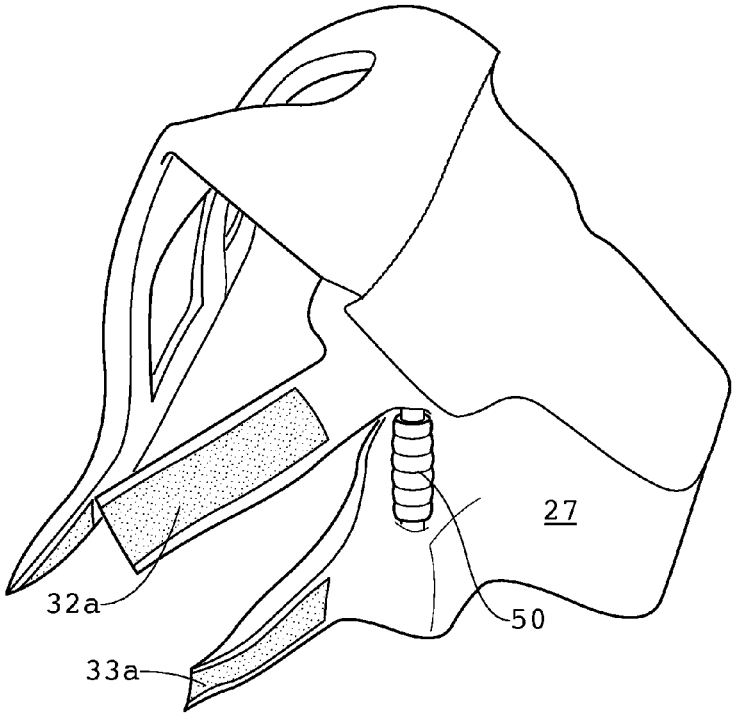
FIG. 3 is a right side view illustrating the embodiment of FIG. 2 not in an operable orientation on a human wearer.

As shown in FIGS. 1 and 3, the central pad 20 has a left side panel 23, a front panel 24, a top panel 25, a bottom panel 26, and a right side panel 27. The central pad 20 is about twelve inches thick from front to back, and tapers from the back to the front so that it narrows the farther away from the wearer's body it extends. The pad 20 is about twelve inches tall at the back (where it contacts the wearer's torso), about ten inches tall at the front (where it is farthest from the wearer's torso), about ten inches wide in the front, and about twelve inches wide at the back. None of these dimensions is critical, but they are useful sizes for operation of the training device 10 considering the type of padding being used, the size of the wearer and other factors. For different padding, smaller or larger wearers, and other uses, it will become apparent to the person of ordinary skill that the size and other characteristics of the central pad 20 can be modified.

For example, in some types of athletic activities, it might be superior to present the training athlete with either a thinner and flatter, or a larger and/or curved, central pad than the central pad 20 described above. In this case, the skin will be modified to accommodate the size of the central pad. Nevertheless, such structures are contemplated as falling within the bounds of the invention.

Figure 2:
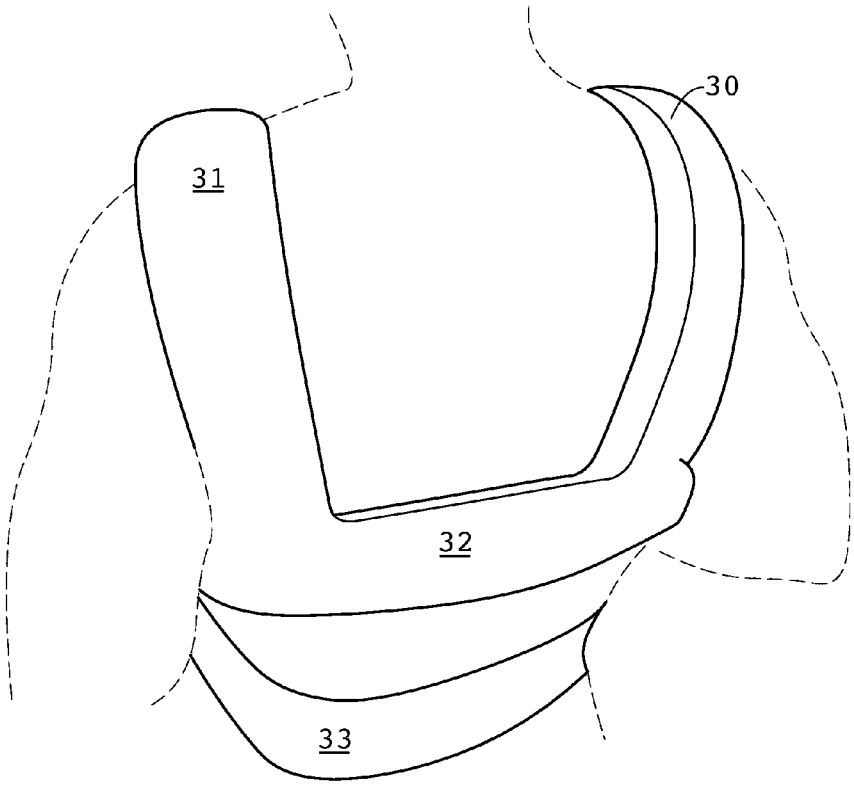
FIG. 2 is a rear view in perspective illustrating an embodiment of the present invention shown in FIG. 1.
Figure 4:
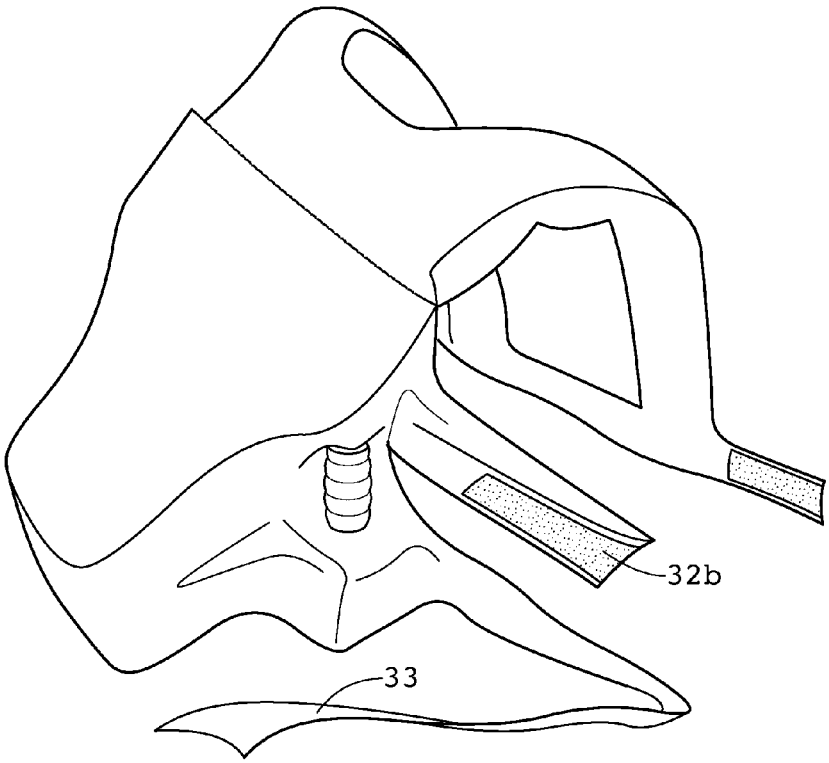
FIG. 4 is a left side view illustrating the embodiment of FIG. 3.
Figure 5:
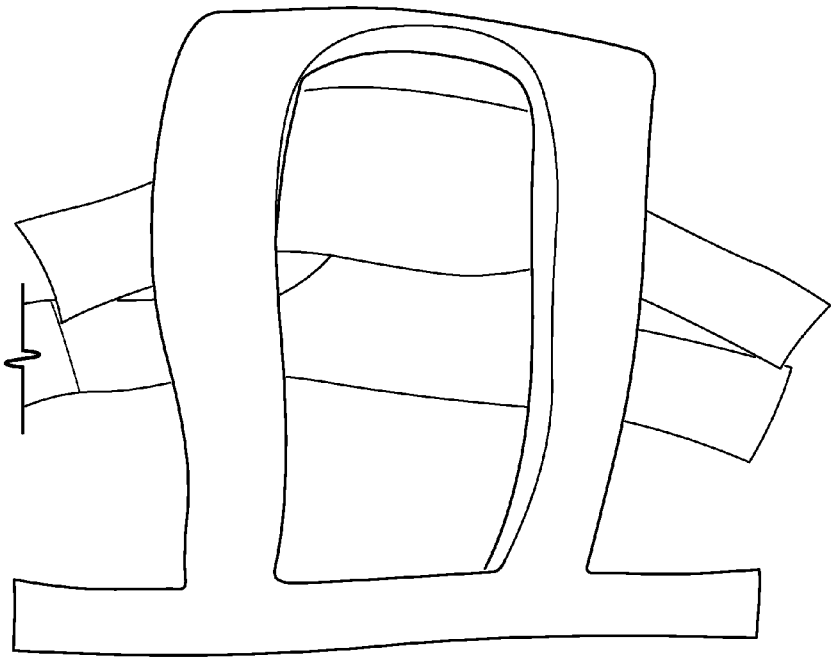
FIG. 5 is a rear view illustrating the embodiment of FIG. 3.

The central pad 20 is preferably disposed at the central anterior of the wearer's body, that is, symmetrically centered in front of the torso. The means for mounting the central pad 20 to the wearer's body can include any structure that envelopes the wearer, which can include one or more of a pair of shoulder straps 30 and 31, and a pair of lateral side straps 32 and 33. When the central pad 20 is positioned in front (anterior) of the wearer, to cover the belly, chest and/or groin of the wearer, the straps 30-33 extend behind the wearer's torso and attach to one another. This mounts the device 10 to the wearer as shown in FIG. 1 in an operable position, and prevents unintentional removal of the training device 10 from the human torso. The shoulder straps 30 and 31 preferably mount to the lateral strap 32, which lateral strap 32 extends under the arms of the human wearer as shown in FIG. 2. Two lateral tabs 32*a* and 32*b* extend from the front of the training device 10, and particularly from the side of the central pad 20 as shown in FIGS. 3 and 4, and attach using conventional fasteners to the opposite ends of the lateral strap 32 beneath the wearer's arms when the device 10 is in an operable position shown in FIGS. 1 and 2. The lateral strap 33 has one long portion and a lateral tab 33*a* to which the lateral strap 33 attaches using conventional fasteners.

Although the above-described mounting means is shown and described in detail, it will become apparent to the person of ordinary skill that any alternative mounting means will suffice to envelope the wearer's body, or portions thereof to mount the device to the wearer. For example, the central pad 20 can be mounted to the front of a vest or shirt that is worn in a conventional manner by the wearer, and the central pad can be incorporated into any garment or quasi-garment, such as an apron. Alternatively, belts, ropes, strings, straps or other structures that extend around the body of the wearer can be used in place of the preferred structure described above, and these can extend around the waist, neck, arms, shoulders and/or legs of the wearer. All such variations of the mounting means are contemplated as falling within the bounds of the invention.

Figure 6:
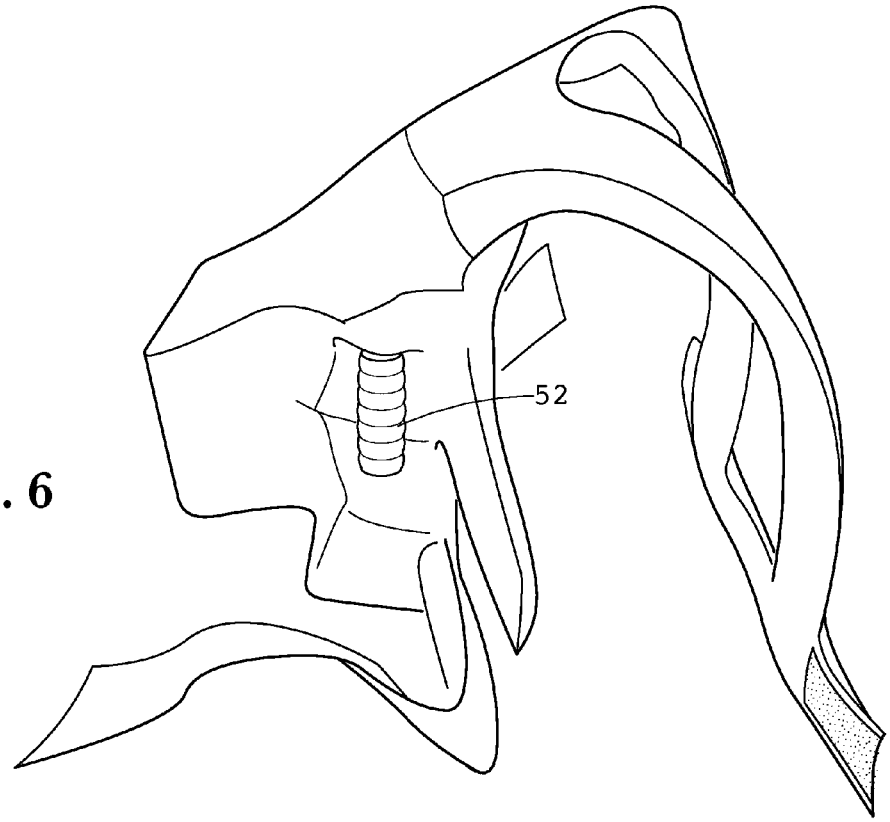
FIG. 6 is a left side view illustrating the embodiment of FIG. 3.
Figure 7:
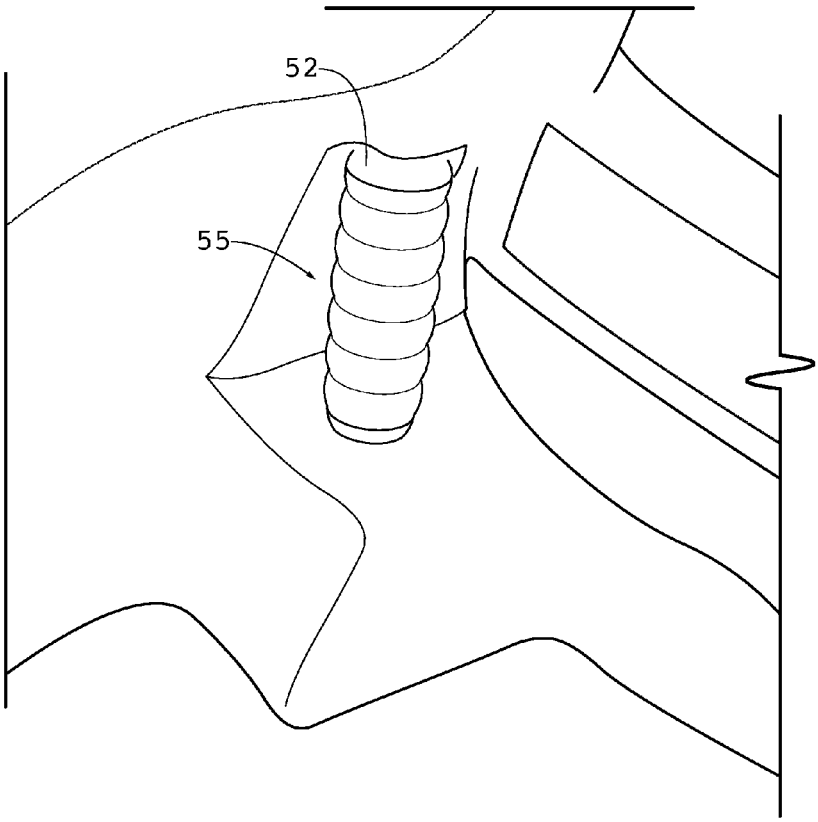
FIG. 7 is a view in perspective illustrating a hand-grippable handle of an embodiment of the present invention.
Figure 8:
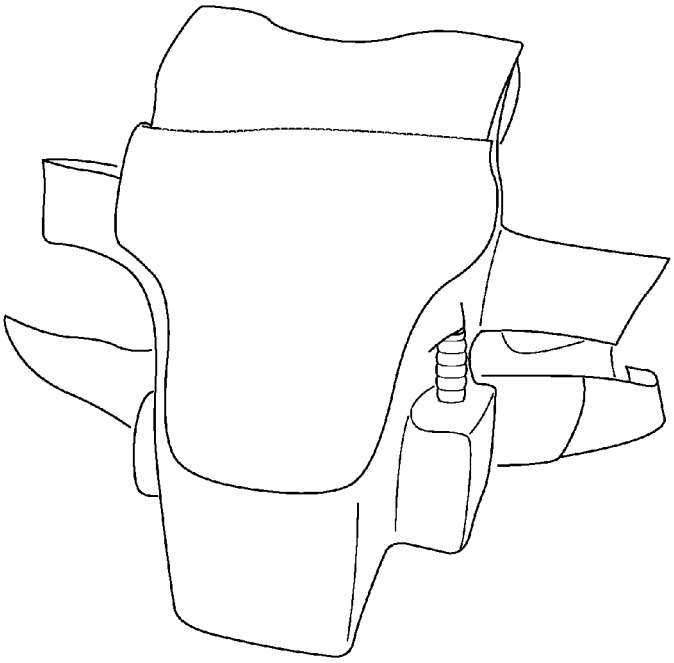
FIG. 8 is a front view illustrating the embodiment of FIG. 3.

At least one, and preferably two, hand-grippable handles are mounted to the central pad 20. The handles 50 and 52 as shown in FIGS. 3, 6 and 7 firmly mount to the skin 22 of the central pad 20 in locations where the wearer's hands naturally locate, such as with elbows bent as shown in FIG. 1. In a preferred embodiment, the central pad 20 has an indentation across which the handles extend to form a space 55 (see FIG. 7) between the handle and the skin 22 into which fingers can be inserted as shown in FIG. 1. When each of the handles 50 and 52 is gripped by the wearer as shown in FIG. 1, the position of the central pad 20 is much better controlled by the wearer, even when the central pad 20 tends to move due to impact by the training athlete's fists, legs, feet, elbows, forearms, etc. This is because the handles 50 and 52 enable the wearer of the training device 10 to grip the device 10 by hand and hold the device firmly in one place. Because the central pad 20 protrudes from the torso of the wearer, there is a possibility that the training athlete's punches, elbows, forearms, knees, and kicks, particularly those with a lateral component of force, will move the central pad 20 away from the wearer to either side, up or down. By gripping the handles 50 and 52 on the sides of the central pad 20, the wearer can tightly hold the central pad 20 to prevent substantial movement of the central pad 20 away from him or her, even when impacted by the training athlete. The wearer can also pull the device 10 toward the wearer's torso to brace the pad 20 against the torso. Furthermore, the handles allow the wearer to brace himself or herself for impact of an imminent blow, and to pull or push the central pad relative to the training athlete's location or an attempted strike. The handles allow the wearer to readily control the position of the central pad 20 by the wearer's hand or hands, thereby ensuring the central pad 20 is in the location that is desired for the best training possible. The handles provide stabilization during impacts, and control of the position of the central pad 20 in case the wearer wants to move the pad 20 away from the training athlete.

The handles are preferably about one inch in diameter and have about four inches of exposed length, which can be coated with a friction-enhancing material, such as rubber. Of course, the sizes are not critical, and are contemplated to be different for different wearers, including juveniles, adults, men and women. The covered portions of the handles extend into cavities in the skin 22 that enclose the ends of the handles to hold the handles in place. The handles can be defined by two exposed portions of a single U-shaped or rectangular-shaped object that extends around inside the skin 22, or even through the central pad 20, that are exposed at the lateral sides of the device 10 for gripping. However, such a structure may have a tendency to interfere with the performance of the padding within the skin 22. Nevertheless, such a structure is contemplated for use in the invention.

Figure 9:
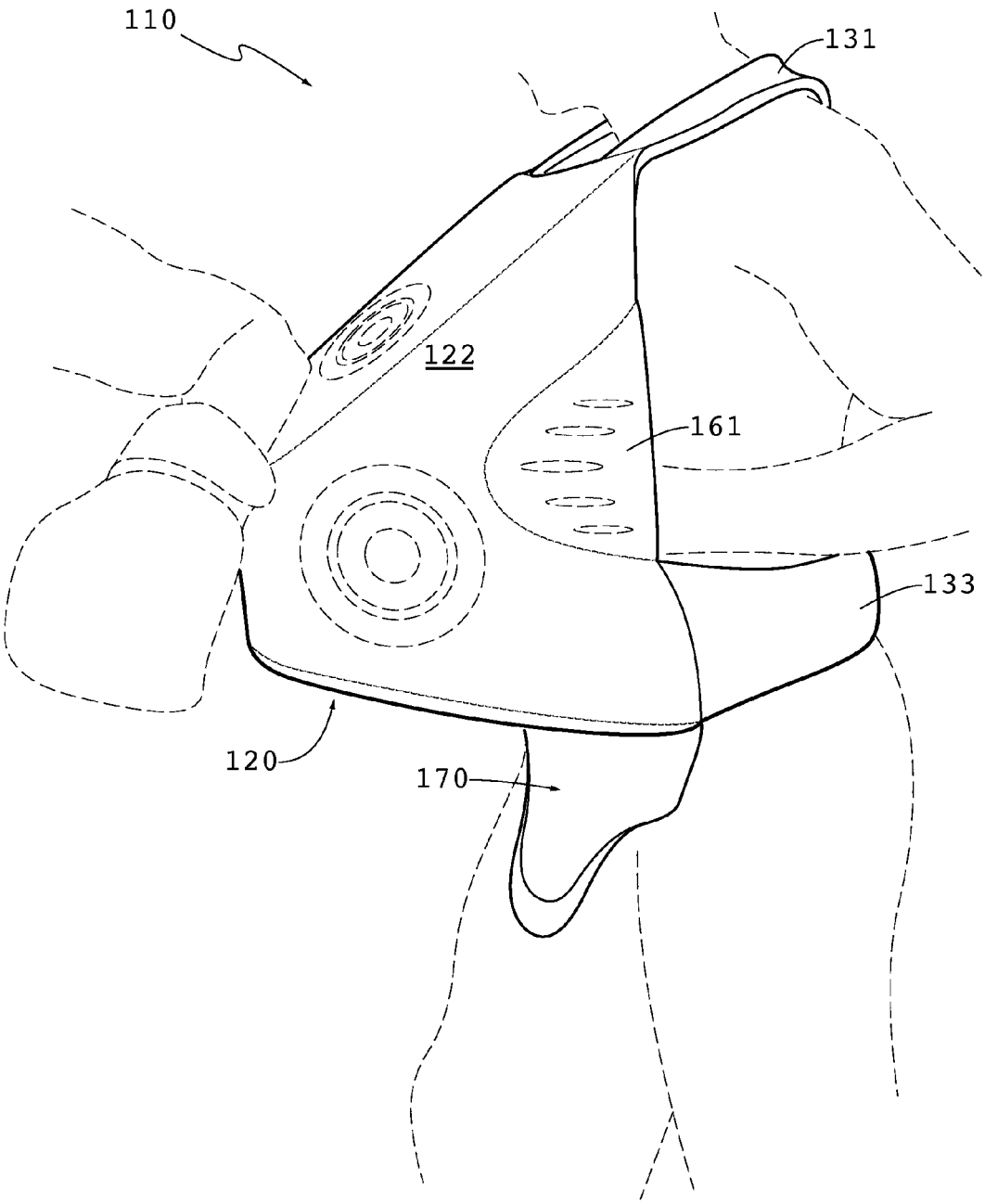
FIG. 9 is a view in perspective illustrating another embodiment of the present invention in an operable position on a human wearer.

Although the wearer can wear padded or otherwise protective gloves to protect his or her hands from punches and kicks while holding the handles 50 and 52, it is also contemplated to provide padded guards, covers or sleeves that form panels that cover the handles 50 and 52 for protection of the wearer's hands when the handles are being gripped (see FIG. 9). Thus, the wearer can extend his or her hands through the covers or sleeves to grasp the handles 50 and 52. Thereupon, any impacts against the wearer's hands or arms are protected by the padded covers or sleeves. Such gloves, covers or sleeves can be foam or a harder material (e.g., plastic or fiber-reinforced plastic) with padding on the inside (in the manner of soccer shin guards) and/or the outside to protect both the wearer and the training athlete.

In use, the training device 10 is mounted firmly to the wearer's torso, with the means for mounting extending around the torso or other body part to maintain positioning. The wearer's hands grip the handles 50 and 52 in the manner shown in FIG. 1, and the central pad 20 protrudes about twelve inches forwardly from the torso of the wearer, centrally located in front of the chest and belly of the wearer. This protrusion allows the training athlete to impact the same while facing the wearer, and impacts can be delivered from below (using the knee and/or thigh in an upwardly-extending motion into the bottom panel 26) and above (using the arm, forearm or elbow in a downward motion into the top panel 25). Furthermore, punching and kicking impacts from the front and both sides are possible at the front panel 24 and side panels 23 and 27, respectively. The exposed panels, with substantial padding contained behind them, can be struck by a training athlete while the trainer or opponent athlete wearing the training device 10 on his or her torso stands still or moves in a manner that simulates an opponent in a contest or in any other suitable way.

While the device 10 has been described herein for use by boxers and martial artists, it is also useful for athletes who have no desire to engage in contact sports, but who wish to train in the manner of a fighter, by delivering blows of varying force to the central pad 20. That is, the training athlete can begin to punch without the full force of a boxer or mixed martial artist. Alternatively, the training athlete can punch, but pull the punch prior to impact to reduce or eliminate the impact. Similarly, the act of raising the leg as if to kick from below with the knee or thigh or the act of raising the leg as if to kick on the front or sides are excellent exercise for core and abdominal muscle workouts. Thus, such leg and knee impacts into the central pad 20 can be carried out without full impact to the central pad 20. Such variations in training athletes using the device 10 will be considered by the person of ordinary skill in view of the description herein.

It is contemplated that various modifications can be made to the training device 10. For example, the protruding central pad 20 can be made smaller or larger for sports or training that require a smaller target or less padding or larger target and more padding. Furthermore, the rear surface of the central pad 20 can be made to conform to the contours of the body of the wearer of the device 10. For example, in martial arts, the chest of the opponent athlete may be smaller than the chest of a boxer. In that case, the rear surface of the central pad 20 can be shaped to conform to the shape of the typical trainer or opponent athlete to minimize injury or weariness of the person wearing the device 10. Similarly, if the device 10 will be worn by female athletes, the rear surface shape can be modified to accommodate the shape of the female physique to reduce injuries and/or weariness of the person wearing the device. Still further, a hard shell, such as a hard plastic or fiber-reinforced plastic, can be interposed between the rear of the central pad and the wearer. Such a shell can be covered with soft foam to further absorb impact energy to the wearer's body. Thus, the hard plastic shell with the soft coating prevents any impact, which would otherwise be transferred through the central pad 20 to the wearer's body, from being so transferred that it would cause injury or discomfort.

In FIG. 9, an alternative embodiment of the present invention is illustrated. The device 110 has a central pad 120 encased by a skin 122 of flexible material, including without limitation nylon-reinforced vinyl. The central pad 120 is not visible in FIG. 9 behind the skin 122, but is an energy-absorbing material, such as a polymer foam, that constitutes the majority of the chamber defined by the walls of the skin 122. The central pad 120 is about eighteen inches tall where it is closest to the wearer's chest and tapers to about ten inches tall at the most anterior region farthest from the trainee's body. The width is about twelve inches at the wearer's chest and tapers to about ten inches wide. The central pad 120 in the embodiment of FIG. 9 extends about the entire height of the wearer's torso, that is, from about the waist to about the neck. The central pad 120 is also about eighteen inches deep from front to back, although this can be modified from as little as a few inches to much more, depending upon the energy-absorbing material used and the amount and direction of force applied. It should be understood that the shape, external contours, and dimensions of the central pad and skin can vary from that shown and described herein. For example, for some uses, the contours can be rounded, and for others the contours can be angular with distinct lines where facets intersect. Alternatively, the shape can be irregular and asymmetrical. Still further, the size of the components, and the relative positions of the enlarged portion of the central pad, can be modified for different uses.

The device 110 is substantially symmetrical, and is described below and illustrated in FIG. 9 from only one side. Two straps 130 (not visible in FIG. 9) and 131 extend rearwardly (posteriorly in the operable orientation of FIG. 9) from the skin 122 and cross one another at about the shoulder blades of the wearer. There are buckles or other fasteners that attach the straps 130 and 131 to the waist straps 132 (not visible in FIG. 9) and 133 that extend around the waist and attach with a buckle or other fastener at about the small of the back. The straps 131-133 have features that permit vertical adjustment of the central pad 120 to accommodate wearers and athletes of varying heights and relative tightness of the device 110 on the wearer's body.

The hand-grippable handles (not visible in FIG. 9, but substantially identical to the handle 52 of the embodiment shown in FIG. 7) are covered by the hand guards 161 and 160 (not visible in FIG. 9). The hand guards are preferably made of the same material as the skin 122, and are preferably contiguous sheets of skin material, that can be reinforced with foam padding or lightweight but rigid plates. For example, plastic plates can be inserted between one layer of material forming the guards and another layer sewn to the first layer to form a planar chamber. When the hands grip the handles as shown in FIG. 9, the hand guards extend over the hands to protect the hands from harm due to impact. Although the handles are shown in the positions described above, they can be modified for other uses, particularly for other uses of the central pad. Also, shapes of the handles can vary from straight, such as curved, angled or even circular. The size can also vary from that shown and described.

A groin guard 170 extends downwardly from the skin 122, directly beneath the central pad 120, over the wearer's groin region in order to protect the wearer in the case of a missed punch, knee, or kick to the device 110. The groin guard 170 can be made of the same material as the skin 122, and can contain a rigid panel, such as plastic or aluminum, and can be padded on the rear side for additional protection.

In the FIG. 9 embodiment, indicia are on the outwardly facing surfaces of the skin 122 in order to assist in training the athlete where to strike for optimal effect. The indicia shown in FIG. 9 are target shapes, with concentric circles, but could alternatively be any shape known to communicate to the training athlete, such as an X, a large circle, a large dot, or any other indicia. Furthermore, indicia are on the skin 122 in order to denote the hand guards 160 and 161, which should be avoided when striking the device 110.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A human-wearable training device configured for mounting to a torso of a human wearer, the training device comprising:

(a) a central pad formed from an energy-absorbing material for receiving strikes, the central pad having:
  (i) a rear surface facing a rearward direction for seating against the human wearer's anterior torso;
  (ii) a front surface that is spaced apart from the rear surface and faces substantially forwardly, opposite the rearward direction, the front surface defining a portion of the central pad that is farthest forward from the rear surface;
  (iii) a left side surface that extends from the rear surface to the front surface;
  (iv) a right side surface that extends from the rear surface to the front surface on an opposite side of the central pad from the left side surface;
  (v) oppositely-facing top and bottom surfaces that extend from the rear surface to the front surface, wherein the left and right side surfaces are arranged in a non-parallel orientation facing substantially opposite directions away from one another and tapering from the larger rear surface to the smaller front surface, and wherein the top surface tapers from the larger rear surface to the smaller front surface, thereby narrowing the central pad the farther away from the rear surface the central pad extends;

(b) at least one strap attached to the central pad for extending rearwardly and wrapping around the human wearer, thereby mounting the central pad in an operable position to a central anterior portion of the torso of the human wearer;

(c) a first hand-grippable handle mounted to the left side surface of the central pad between the front and rear surfaces for grasping by a first hand of the human wearer; and (d) a second hand-grippable handle mounted to the right side surface of the central pad between the front and rear surfaces for grasping by a second hand of the human wearer, wherein the central pad is disposed at least partially between the first and second handles.

2. The training device in accordance with claim 1, further comprising a first guard extending over the first handle and a second guard extending over the second handle for protecting the first hand and the second hand, respectively, when the first and second hands grasp the first and second handles.

3. The training device in accordance with claim 2, wherein the first and second guards are panels extending from the central pad.

4. The training device in accordance with claim 1, wherein the energy-absorbing material of the central pad is compressible polymer foam.

5. The training device in accordance with claim 1, further comprising a groin guard extending from the central pad for extending over a groin region of the human wearer.

6. The training device in accordance with claim 1, wherein a flexible skin extends around the central pad and at least a portion of the human wearer's torso.

7. A human-wearable training device configured for mounting to a torso of a human wearer, the training device comprising:

(a) a central pad formed from an energy-absorbing material for receiving impacts, the central pad having oppositely-facing rear and front faces between which extend oppositely-facing, non-parallel left and right faces and oppositely-facing top and bottom faces, wherein the rear face is configured to seat against an anterior portion of the human wearer's torso with the front face defining a portion of the central pad that is farthest from the rear surface, wherein the central pad tapers along the left, right, and top faces from the larger rear face to the smaller front face, thereby narrowing the central pad the farther away from the rear face the central pad extends;

(b) at least one strap extending from the central pad for extending around the torso of the human wearer for mounting the central pad in an operable position to the central anterior portion of the torso;

(c) a first hand-grippable handle mounted to the left face between the front and rear faces for gripping by a first hand of the human wearer; and (d) a second hand-grippable handle mounted to the right face between the front and rear faces for gripping by a second hand of the human wearer, wherein the central pad is disposed at least partially between the first and second handles.

8. The training device in accordance with claim 7, further comprising a first guard extending over the first handle and a second guard extending over the second handle for protecting the first hand and the second hand, respectively, when the hands grip the first and second handles.

9. The training device in accordance with claim 8, wherein the first and second guards are panels extending from the central pad.

10. The training device in accordance with claim 7, wherein the energy-absorbing material of the central pad is compressible polymer foam.

11. The training device in accordance with claim 7, further comprising a groin guard extending from the central pad for extending over a groin region of the human wearer.

12. The training device in accordance with claim 7, wherein a flexible skin extends around the central pad and is configured to extend around at least a portion of the human wearer's torso.

13. A human-wearable training device mounted to a human wearer, the training device comprising:

(a) a central pad formed from an energy-absorbing material for receiving impacts, the central pad positioned on a central anterior portion of the human wearer and having:

(i) a rear surface seating against the human wearer's anterior torso;

(ii) a front surface that is spaced apart from the rear surface and faces substantially anteriorly, the front surface defining a portion of the central pad that is farthest anteriorly from the rear surface;

(iii) a left side surface that extends from the rear surface to the front surface;

(iv) a right side surface that extends from the rear surface to the front surface on an opposite side of the central pad from the left side surface:

(v) oppositely-facing top and bottom surfaces that extend from the rear surface to the front surface, wherein the left and right side surfaces are arranged in a non-parallel orientation facing substantially opposite directions away from one another and tapering from the larger rear surface to the smaller front surface, and wherein the top surface tapers from the larger rear surface to the smaller front surface, thereby narrowing the central pad the farther away from the human wearer's anterior torso the central pad extends;

(b) an envelope extending from the central pad to and around the human wearer, thereby mounting the central pad to the human wearer in an operable position;

(c) a first hand-grippable handle mounted to the left side surface between the front and rear surfaces and grasped by a first hand of the human wearer; and (d) a second hand-grippable handle mounted to the right side surface between the front and rear surfaces, and grasped by a second hand of the human wearer, wherein the central pad is disposed at least partially between the first and second handles.

14. The training device in accordance with claim 13, further comprising a first guard extending over the first handle and a second guard extending over the second handle for protecting the first hand and the second hand, respectively.

15. The training device in accordance with claim 14, wherein the first and second guards are panels extending from the central pad.

16. The training device in accordance with claim 14, wherein a flexible skin extends around the central pad and at least a portion of the human wearer's torso.

17. The training device in accordance with claim 13, wherein the energy-absorbing material of the central pad is compressible polymer foam.

18. The training device in accordance with claim 13, wherein the envelope further comprises at least one strap extending around at least one of a neck, arm, waist and shoulder of the human wearer.

19. The training device in accordance with claim 13, wherein the envelope further comprises at least one strap extending around a torso of the human wearer.

20. The training device in accordance with claim 13, further comprising a groin guard extending from the central pad over a groin region of the human wearer.

21. A method of using a human-wearable training device, the method comprising:

(a) disposing a central pad formed from an energy-absorbing material in an operable position at a central anterior portion of a human wearer, the pad having:

(i) a rear surface seating against the human wearer's anterior torso;

(ii) a front surface that is spaced apart from the rear surface and faces substantially anteriorly, the front surface defining a portion of the central pad that is farthest anteriorly from the rear surface;

(iii) a left side surface that extends from the rear surface to the front surface; and (iv) a right side surface that extends from the rear surface to the front surface on an opposite side of the central pad from the left side surface;

(v) oppositely-facing top and bottom surfaces that extend from the rear surface to the front surface; wherein the left and right side surfaces are arranged in a non-parallel orientation facing substantially opposite directions away from one another and tapering from the larger rear surface to the smaller front surface, and wherein the top surface tapers from the larger rear surface to the smaller front surface, thereby narrowing the central pad the farther away from the rear surface the central pad extends;

(b) mounting the central pad to the human wearer in an operable position by extending around the human wearer an envelope mounted to the central pad;

(c) grasping, by a first hand of the human wearer, a first hand-grippable handle mounted to the left side surface between the front and rear surfaces;

(d) grasping, by a second hand of the human wearer, a second hand-grippable handle mounted to the right side surface between the front and rear surfaces; and (e) the human wearer disposing the central pad between the first and second hands.

22. The method in accordance with claim 21, further comprising a training athlete striking at least one of the left and right side surfaces of the central pad with an athlete's hands while the central pad is in the operable position.

23. The method in accordance with claim 22, further comprising a training athlete striking at least one of the left and right side surfaces of the central pad with an athlete's legs while the central pad is in the operable position.

24. The method in accordance with claim 21, wherein the step of mounting further comprises extending at least one strap around at least one of a neck, arm, waist and shoulder of the human wearer.

25. The method in accordance with claim 21, wherein the step of mounting further comprises extending at least one strap around a torso of the human wearer.

26. The method in accordance with claim 21, further comprising extending a groin guard from the central pad over a groin region of the human wearer.

27. The method in accordance with claim 21, further comprising extending a first guard over the first handle and extending a second guard over the second handle for protecting the first hand and the second hand, respectively.

* * * * *